US010524056B2

(12) United States Patent
Chen

(10) Patent No.: US 10,524,056 B2
(45) Date of Patent: Dec. 31, 2019

(54) LOUDSPEAKER MAGNETIC CIRCUIT SYSTEM HAVING U-SHAPED SHORT-CIRCUIT RING

(71) Applicant: TYMPHANY ACOUSTIC TECHNOLOGY (HUIZHOU) CO., LTD., Huizhou, Guangdong Province (CN)

(72) Inventor: Zhi Chen, Huizhou (CN)

(73) Assignee: Tymphany Acoustic Technology (Huizhou) Co., Ltd., Huizhou, Guangdong Province (CN)

( * ) Notice: Subject to any disclaimer, the term of this patent is extended or adjusted under 35 U.S.C. 154(b) by 0 days.

(21) Appl. No.: 16/138,000

(22) Filed: Sep. 21, 2018

(65) Prior Publication Data

US 2019/0090063 A1 Mar. 21, 2019

(30) Foreign Application Priority Data

Sep. 21, 2017 (CN) ..... 2017 1 0857148

(51) Int. Cl.
*H04R 9/02* (2006.01)
*H04R 9/06* (2006.01)

(52) U.S. Cl.
CPC ..... *H04R 9/025* (2013.01); *H04R 9/06* (2013.01)

(58) Field of Classification Search
CPC . H04R 9/02; H04R 9/06; H04R 9/025; H04R 2209/021; H04R 2400/11
See application file for complete search history.

(56) References Cited

U.S. PATENT DOCUMENTS

2005/0190945 A1* 9/2005 Calderwood ..... H04R 9/025 381/412
2013/0163806 A1* 6/2013 North ..... H04R 9/025 381/396
2016/0037258 A1* 2/2016 Wilkes, Jr. ..... H04R 5/02 381/307

* cited by examiner

*Primary Examiner* — Brian Ensey
(74) *Attorney, Agent, or Firm* — Muncy, Geissler, Olds & Lowe, P.C.

(57) ABSTRACT

A loudspeaker magnetic circuit system includes an iron a magnetic steel, a spring washer, a voice coil and a U-shaped short-circuit ring. The U-shaped short-circuit ring includes a first ring body and a second ring body, and the voice coil is positioned and movable up and down in a U-shaped groove formed by the first ring body and the second ring body. Through making the short-circuit ring into a U-shaped structure and optimizing the connection relationship between the short-circuit ring and other components such as the spring washer, magnetic steel and iron, the present invention can effectively reduce the harmonic distortion and non-linear distortion of the loudspeaker and improve the overall acoustic performance of the speaker such that the sound quality of loudspeaker is improved.

11 Claims, 4 Drawing Sheets

LOUDSPEAKER MAGNETIC CIRCUIT SYSTEM HAVING U-SHAPED SHORT-CIRCUIT RING

CROSS REFERENCE TO RELATED APPLICATIONS

This application claims priority to CN 201710857148.0, which was filed on Sep. 21, 2017, and which is herein incorporated by reference.

FIELD OF THE INVENTION

The present invention relates to the technical field of loudspeaker manufacturing, in particular, to a loudspeaker magnetic circuit system having a U-shaped short-circuit ring.

BACKGROUND OF THE INVENTION

During the operation of a loudspeaker, when the external drive current drives the voice coil to vibrate, an induced current in an opposite direction may also be incurred, especially when in high frequency, the self-inductance of the voice coil is so large that the induced current becomes large such that the operation of the loudspeaker is influenced to lead to damage to high frequency response.

In traditional a loudspeaker, a short-circuit ring is disposed below the spring washer and around the magnet to slow down the increasing speed of electrical resistance of the loudspeaker with the frequency. The short-circuit ring can counteract the effects on the magnetic field in the loudspeaker from the induced current of the voice coil, reduce the resistance of the loudspeaker in high frequency, play a role in decreasing harmonic distortion and the inductance of voice coil.

In extant structural design, the short-circuit ring is generally disposed on the inside of the voice coil and the sleeve-connected on the T iron or spring washer; or is disposed on the inside of the magnetic steel or the U iron while being positioned on the outside of the voice coil; or is used by means of combining the above two arrangements. However, in the above application of the short-circuit ring, the high calorific value of the cartridge of the T iron is not conducive to the magnetic stability during the operation of loudspeaker, and the effect of improving the harmonic distortion and non-linear distortion of the loudspeaker is still not very obvious.

Therefore, it is necessary to improve the design of extant loudspeaker magnetic circuit systems so as to decrease the harmonic distortion effectively and improve the overall acoustic performance of the loudspeaker. Furthermore, it is a technical problem to be solved by those skilled in the art to determine how to improve effectively the harmonic distortion and the non-linear distortion of the loudspeaker.

SUMMARY OF THE INVENTION

To solve the above problems existing in the current art, the present invention provides a loudspeaker magnetic circuit system having a U-shaped short-circuit ring. Through making the short-circuit ring into a U-shaped structure and optimizing the connection relationship between the short-circuit ring and other components such as the spring washer, magnetic steel and T iron, the present invention can effectively reduce the harmonic distortion and non-linear distortion of the loudspeaker and improve the overall acoustic performance of the speaker such that the sound quality of the loudspeaker is improved.

To achieve the above purpose, the present invention further provides the following technical scheme:

a loudspeaker magnetic circuit system having a U-shaped short-circuit ring, comprises an iron, a magnetic steel, a spring washer, a voice coil and a U-shaped short-circuit ring, wherein the iron includes a transverse portion and a vertical portion extending upward from the transverse portion, the magnetic steel and the spring washer are positioned above the transverse portion, and the inner side of the spring washer is closer to the vertical portion than the inner side of the magnetic steel; an iron gap slot is formed between the magnetic steel, the spring washer and the vertical portion, the voice coil and the U-shaped short-circuit ring being positioned in the iron gap slot; the U-shaped short-circuit ring comprises a first ring body and a second ring body, and the voice coil is positioned and movable up and down in a U-shaped groove formed by the first ring body and the second ring body; the first ring body is sleeve-connected on the vertical portion and the second ring body is sleeve-connected on the magnetic steel or the spring washer.

As a further description for the technical scheme of the present invention, the iron is a T-shaped iron and in that the vertical portion extending upward from the center of the transverse portion.

The U-shaped short-circuit ring is a short-circuit ring with a U-shaped cross section, which is formed integrally, or the U-shaped structure may be formed through connection by means of glue, welding and the like. The U-shaped short-circuit ring comprises a first ring body sleeve-connected to the vertical portion of the T iron and a second ring body sleeve-connected to the spring washer or magnetic steel, wherein the first and second ring body form a U-shaped groove; the voice coil is disposed in the U-shaped groove of the short-circuit ring and a gap between inside and outside remains, so when an electrical signal is connected, the ring coil moves up and down in the U-shaped groove. A U-shaped short-circuit ring with such structure is advantageous in that it has the effect that it can effectively decrease the inductance of the voice coil, increase the frequency response of the loudspeaker, improve the distortion of the loudspeaker and ensure the overall acoustic performance of the loudspeaker.

As a further description for the technical scheme of the present invention, the bottom of the U-shaped short-circuit ring is positioned at the intersection of the transverse portion and the vertical portion of the T-shaped iron. The U-shaped short-circuit is fitted closely with the T-shaped iron to reduce the effects on the magnetic gap space for the stability of the magnetic circuit system.

As a preferable technical scheme, the first ring body conducts a U-shaped bend downwardly at the end and then is sleeve-connected to the upper end of the vertical portion; the second ring body conducts a U-shaped bend downwardly at the end and then is sleeve-connected to the upper end of the spring washer.

As another preferable technical scheme, the first ring body conducts a U-shaped bend downwardly at the end and then is sleeve-connected to the upper end of the vertical portion; the second ring body is sleeve-connected to the lower end of the spring washer.

As another preferable technical scheme, a protrusion is formed outward at the upper end of the vertical portion and the first ring body is sleeve-connected to the lower end of the protrusion; the second ring body is sleeve-connected to the lower end of the spring washer.

In the above technical schemes, the first and second ring body are sleeve-connected with the vertical portion of the T iron and spring washer respectively by utilizing different connection structures such that the arrangement for connection relationship of the short-circuit ring in the magnetic circuit system is well achieved. This is advantageous in that it has the effect of reducing the distortion of the loudspeaker and improving the overall acoustic performance of the loudspeaker. Further, the fixed position of the short-circuit ring is advantageous in that the stability for magnetic field during the operation of loudspeaker is ensured.

Moreover, the present invention relates to a loudspeaker magnetic circuit system having a U-shaped short-circuit ring, wherein the iron is a U-shaped iron and the width of the spring washer is greater than the width of the magnetic steel.

Similar to the magnetic circuit system with T-shaped iron structure, the U-shaped short-circuit ring comprises a first ring body sleeve-connected to the vertical portion of the T iron (protrusion portion of the U-shaped iron) and a second ring body sleeve-connected to the spring washer or magnetic steel, wherein the first and second ring body form a U-shaped groove; the voice coil is disposed in the U-shaped groove of the short-circuit ring and a gap between inside and outside remains, so when an electrical signal is connected, the ring coil moves up and down in the U-shaped groove. The magnetic circuit system with U-shaped iron structure is advantageous in that it has the effect that, the U-shaped short-circuit ring can also effectively decrease the inductance of the voice coil, increase the frequency response of the loudspeaker, improve the distortion of the loudspeaker and ensure improved overall acoustic performance of the loudspeaker.

As a further description for the technical scheme of the present invention, the bottom of the U-shaped short-circuit ring is positioned at the intersection of the bottom and the protruding portion of the U-shaped iron. The U-shaped short-circuit is fitted closely with the U-shaped iron to reduce the effects on the magnetic gap space for the stability of the magnetic circuit system.

As a preferable technical scheme, the first ring body conducts a U-shaped bend downwardly at the end and then is sleeve-connected to the upper end of the spring washer; the second ring body conducts a U-shaped bend downwardly at the end and then is sleeve-connected to the upper end of the protruding portion.

As another preferable technical scheme, a protruding block is formed inward from above the protruding portion and the second ring body is sleeve-connected to the lower end of the protruding block; the first ring body conducts a U-shaped bend downwardly at the end and then is sleeve-connected to the upper end of the spring washer.

As another preferable technical scheme, a protruding block is formed inward at the upper end of the protruding portion and the second ring body is sleeve-connected to the lower end of the protruding block; the first ring body is sleeve-connected to the lower end of the spring washer.

In the above technical schemes of a magnetic circuit system with U-shaped iron structure, the first and second ring body is sleeve-connected with the protruding portion of the U iron and spring washer respectively by utilizing different connection structures such that the arrangement for connection relationship of the short-circuit ring in the magnetic circuit system is well achieved. This is advantageous in that it has the effect of reducing the distortion of the loudspeaker and improving the overall acoustic performance of the loudspeaker.

Based on above technical schemes, beneficial effects acquired by the present invention are as below:

(1) In the loudspeaker magnetic circuit system having U-shaped short-circuit ring provided by the present invention, through making the short-circuit ring into a U-shaped structure and optimizing the connection relationship between the short-circuit ring and other components such as the spring washer, magnetic steel and T (U) iron, the present invention can effectively reduce the harmonic distortion and non-linear distortion of the loudspeaker and improve the overall acoustic performance of the speaker such that the sound quality of loudspeaker is improved.

(2) In the loudspeaker magnetic circuit system having U-shaped short-circuit ring provided by the present invention, the U-shaped short-circuit ring comprises a first ring body and a second ring body, which are respectively sleeve-connected with the T (U) iron and spring washer by utilizing different connection structures, therefore the overall magnetic circuit system becomes stable and variations in non-linear inductance within the magnetic circuit system decrease to reduce distortion, and the U-shaped short-circuit ring can slow down the increase of electrical resistance for the voice coil with the frequency so as to increase the frequency response output range of loudspeaker.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

To facilitate understanding, the invention will be described in detail in combination with drawings and specific embodiments. The drawings illustrate preferred embodiments of the present invention. However, the present invention can be embodied in many different forms, and is not limited to the embodiments described herein. Rather, the purpose of providing these embodiments is to make the disclosure of the present invention more comprehensively understood.

It should be noted that when an element is referred to as being "fixed to" another element, it may be directly on another element or there may also be an intermediate element. When an element is considered to be "connected" to another element, it can be connected directly to another element or may also have an intermediate element.

Unless otherwise defined, all technical and scientific terms used herein have the same meaning as commonly understood by those skilled in the art to which this invention pertains. The terminology used herein in the specification of the present invention is for the purpose of describing particular embodiments only and is not intended to limit the invention.

Embodiment 1

Figure 1:
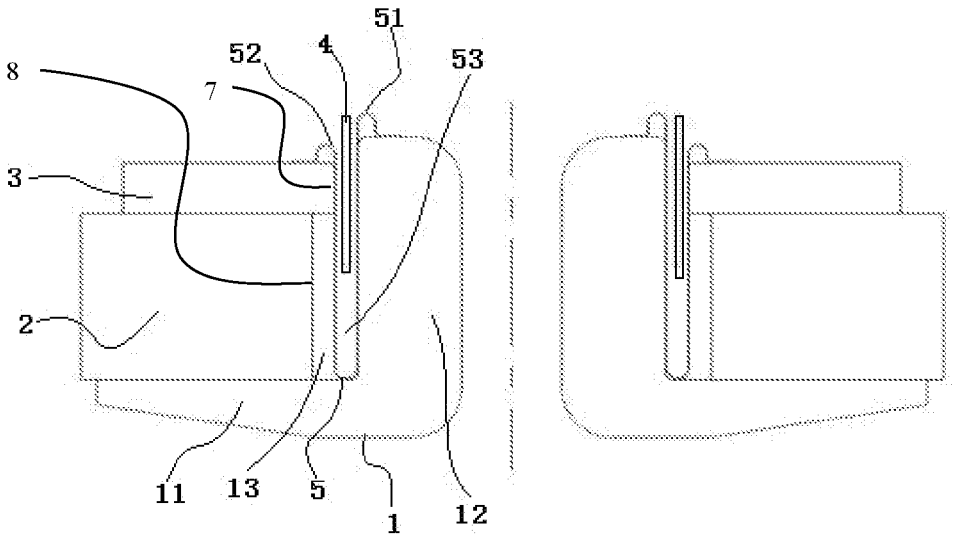
FIG. 1 is a section view of the loudspeaker magnetic circuit system having U-shaped short-circuit ring in Embodiment 1 with a T-shaped iron.

FIG. 1 illustrates a section view of the loudspeaker magnetic circuit system having a U-shaped short-circuit ring in Embodiment 1. As shown in FIG. 1, a loudspeaker magnetic circuit system having a U-shaped short-circuit ring comprises a T-shaped iron 1, a magnetic steel 2, a spring washer 3, a voice coil 4 and a U-shaped short-circuit ring 5. The T-shaped iron 1 includes a transverse portion 11 and a vertical portion 12 vertically disposed above the center of the transverse portion 11. The magnetic steel 2 and the spring washer 3 are disposed in turn above the transverse portion 11, i.e. the magnetic steel 2 and the spring washer 3 are located in turn above the transverse portion 11. The inner side of the spring washer 3 is closer to the vertical portion 12 than the inner side of the magnetic steel 2. A T iron gap slot 13 is formed between the magnetic steel 2, the spring washer 3 and the vertical portion 12, and the voice coil 4 and the U-shaped short-circuit ring 5 are positioned in the T iron gap slot 13.

The bottom of the U-shaped short-circuit ring 5 is positioned at the intersection of the transverse portion 11 and the vertical portion 12 of the T-shaped iron 1. The U-shaped short-circuit 5 is fitted closely with the T-shaped iron 1 to reduce the effects on the magnetic gap space for the stability of the magnetic circuit system.

Further, the U-shaped short-circuit ring 5 comprises a first ring body 51 and a second ring body 52, and the voice coil 4 is positioned and movable up and down in a U-shaped groove 53 formed by the first ring body 51 and the second ring body 52.

In the present embodiment, the first ring body 51 conducts a U-shaped bend at the end and then is sleeve-connected to the upper end of the vertical portion 12. The second ring body 52 conducts a U-shaped bend downwardly at the end and then is sleeve-connected to the upper end of the spring washer 3.

Figure 2:
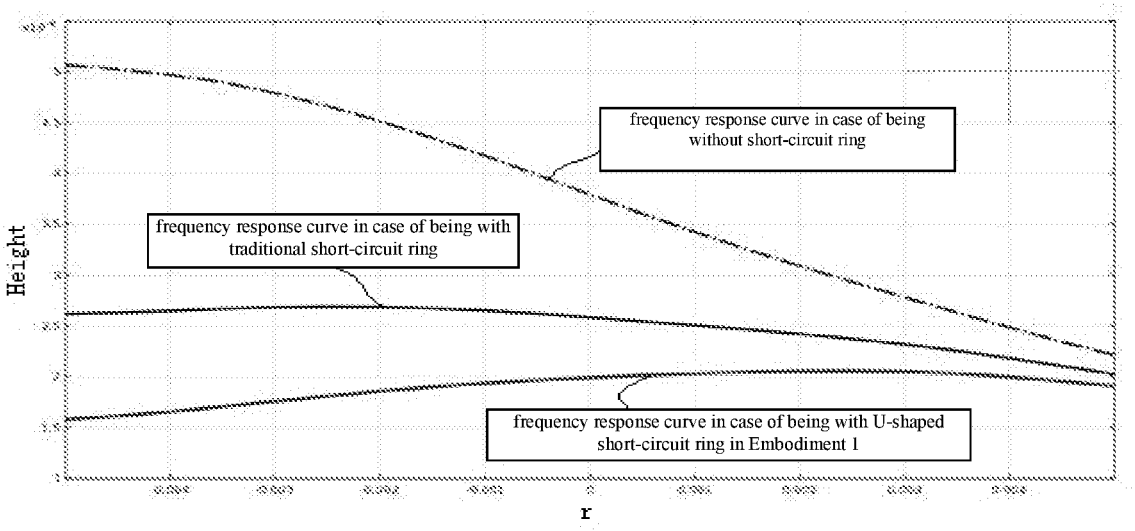
FIG. 2 illustrates simulation results of the loudspeaker magnetic circuit system having U-shaped short-circuit ring in Embodiment 1.

FIG. 2 illustrates simulation results of the loudspeaker magnetic circuit system having U-shaped short-circuit ring in an embodiment of the invention. As shown in FIG. 2, the U-shaped short-circuit ring employing the present invention has a better simulation result than that of the traditional short-circuit ring and that without short-circuit ring.

In the loudspeaker magnetic circuit system of the present embodiment, the short-circuit ring is made into a U-shaped structure comprising a first ring body and a second ring body and the first ring body and second ring body are respectively sleeve-connected with the vertical portion and spring washer such that the overall magnetic circuit system becomes stable and variations in non-linear inductance within the magnetic circuit system decrease to reduce distortion for effectively reducing the harmonic distortion and non-linear distortion of loudspeaker, and the U-shaped short-circuit ring can slow down the increase of electrical resistance for the voice coil with the frequency so as to increase the frequency response output range of the loudspeaker, enhance the overall acoustic performance of the speaker and improve the sound quality of loudspeaker.

Embodiment 2

Figure 3:
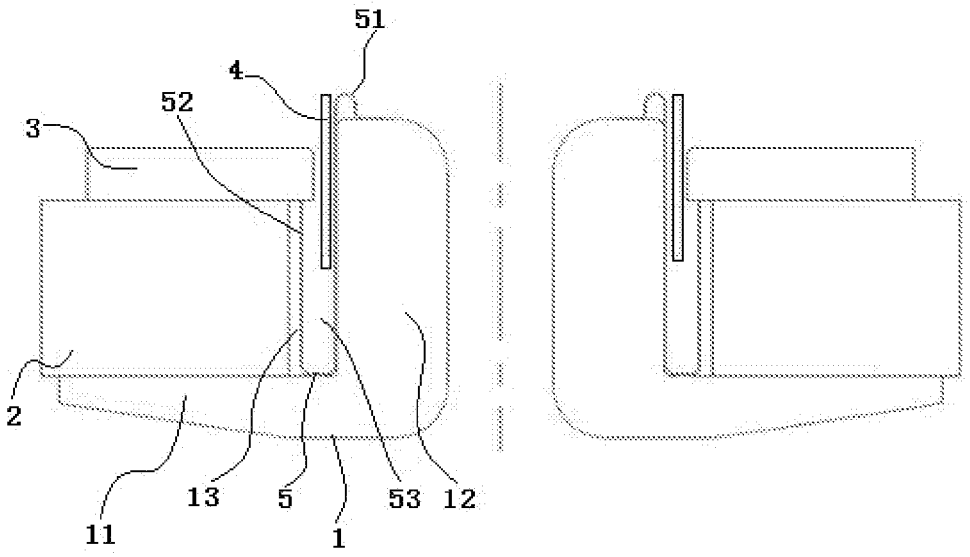
FIG. 3 is a section view of the loudspeaker magnetic circuit system having U-shaped short-circuit ring in Embodiment 2.

FIG. 3 illustrates a section view of the loudspeaker magnetic circuit system having a U-shaped short-circuit ring in Embodiment 2. As shown in FIG. 3, a loudspeaker magnetic circuit system having a U-shaped short-circuit ring comprises a T-shaped iron 1, a magnetic steel 2, a spring washer 3, a voice coil 4 and a U-shaped short-circuit ring 5. The T-shaped iron 1 includes a transverse portion 11 and a vertical portion 12 vertically disposed above the center of the transverse portion 11. The magnetic steel 2 and the spring washer 3 are disposed in turn above the transverse portion 11, i.e. the magnetic steel 2 and the spring washer 3 are located in turn above the transverse portion 11. The inner side of the spring washer 3 is closer to the vertical portion 12 than the inner side of the magnetic steel 2. A T iron gap slot 13 is formed between the magnetic steel 2, the spring washer 3 and the vertical portion 12, and the voice coil 4 and the U-shaped short-circuit ring 5 are positioned in the T iron gap slot 13.

The bottom of the U-shaped short-circuit ring 5 is positioned at the intersection of the transverse portion 11 and the vertical portion 12 of the T-shaped iron 1. The U-shaped short-circuit 5 is fitted closely with the T-shaped iron 1 to reduce the effects on the magnetic gap space for the stability of the magnetic circuit system.

Further, the U-shaped short-circuit ring 5 comprises a first ring body 51 and a second ring body 52, and the voice coil 4 is positioned and movable up and down in a U-shaped groove 53 formed by the first ring body 51 and the second ring body 52.

In the present embodiment, the first ring body 51 conducts a U-shaped bend downwardly at the end and then is sleeve-connected to the upper end of the vertical portion 12. The second ring body 52 is sleeve-connected to the lower end of the spring washer 3.

In the loudspeaker magnetic circuit system of the present embodiment, the short-circuit ring is made into a U-shaped structure comprising a first ring body and a second ring body and the first ring body and second ring body are respectively sleeve-connected with the vertical portion and spring washer such that the overall magnetic circuit system becomes stable and variations in non-linear inductance within the magnetic circuit system decrease to reduce distortion for effectively reducing the harmonic distortion and non-linear distortion of loudspeaker, and the U-shaped short-circuit ring can slow down the increase of electrical resistance for the voice coil with the frequency so as to increase the frequency response output range of loudspeaker, enhance the overall acoustic performance of the speaker and improve the sound quality of loudspeaker.

Embodiment 3

Figure 4:
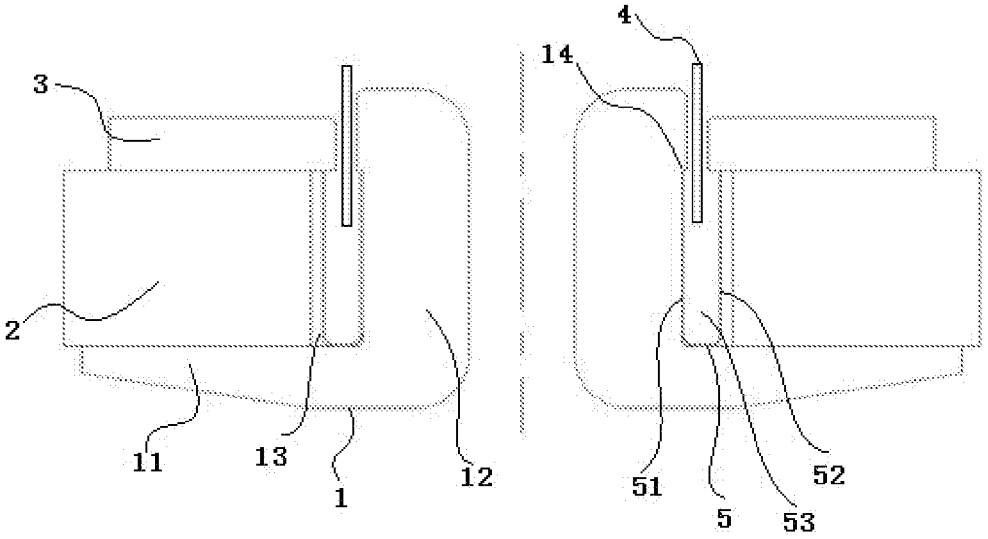
FIG. 4 is a section view of the loudspeaker magnetic circuit system having U-shaped short-circuit ring in Embodiment 3.

FIG. 4 illustrates a section view of the loudspeaker magnetic circuit system having a U-shaped short-circuit ring in Embodiment 3. As shown in FIG. 4, a loudspeaker magnetic circuit system having a U-shaped short-circuit ring comprises a T-shaped iron 1, a magnetic steel 2, a spring washer 3, a voice coil 4 and a U-shaped short-circuit ring 5. The T-shaped iron 1 includes a transverse portion 11 and a vertical portion 12 vertically disposed above the center of the transverse portion 11. The magnetic steel 2 and the spring washer 3 are disposed in turn above the transverse portion 11, i.e. the magnetic steel 2 and the spring washer 3 are located in turn above the transverse portion 11. The inner side of the spring washer 3 is closer to the vertical portion 12 than the inner side of the magnetic steel 2. A T iron gap slot 13 is formed between the magnetic steel 2, the spring washer 3 and the vertical portion 12, and the voice coil 4 and the U-shaped short-circuit ring 5 are positioned in the T iron gap slot 13.

The bottom of the U-shaped short-circuit ring 5 is positioned at the intersection of the transverse portion 11 and the vertical portion 12 of the T-shaped iron 1. The U-shaped short-circuit 5 is fitted closely with the T-shaped iron 1 to reduce the effects on the magnetic gap space for the stability of the magnetic circuit system.

Further, the U-shaped short-circuit ring 5 comprises a first ring body 51 and a second ring body 52, and the voice coil 4 is positioned and movable up and down in a U-shaped groove 53 formed by the first ring body 51 and the second ring body 52.

In the present embodiment, a protrusion 14 is formed outward from above the vertical portion 12 and the first ring body 51 is sleeve-connected to the lower end of the protrusion 14. The second ring body 52 is sleeve-connected to the lower end of the spring washer 3.

In the loudspeaker magnetic circuit system of the present embodiment, the short-circuit ring is made into a U-shaped structure comprising a first ring body and a second ring body and the first ring body and second ring body are respectively sleeve-connected with the vertical portion and spring washer such that the overall magnetic circuit system becomes stable and variations in non-linear inductance within the magnetic circuit system decrease to reduce distortion for effectively reducing the harmonic distortion and non-linear distortion of loudspeaker, and the U-shaped short-circuit ring can slow down the increase of electrical resistance for the voice coil with the frequency so as to increase the frequency response output range of loudspeaker, enhance the overall acoustic performance of the speaker and improve the sound quality of loudspeaker.

Embodiment 4

The vertical portion 12 in specific embodiments of the invention may be referred to as bottom portion 61. In the same way, sometimes the transverse portion 11 may be referred to as protruding portion 62.

Figure 5:
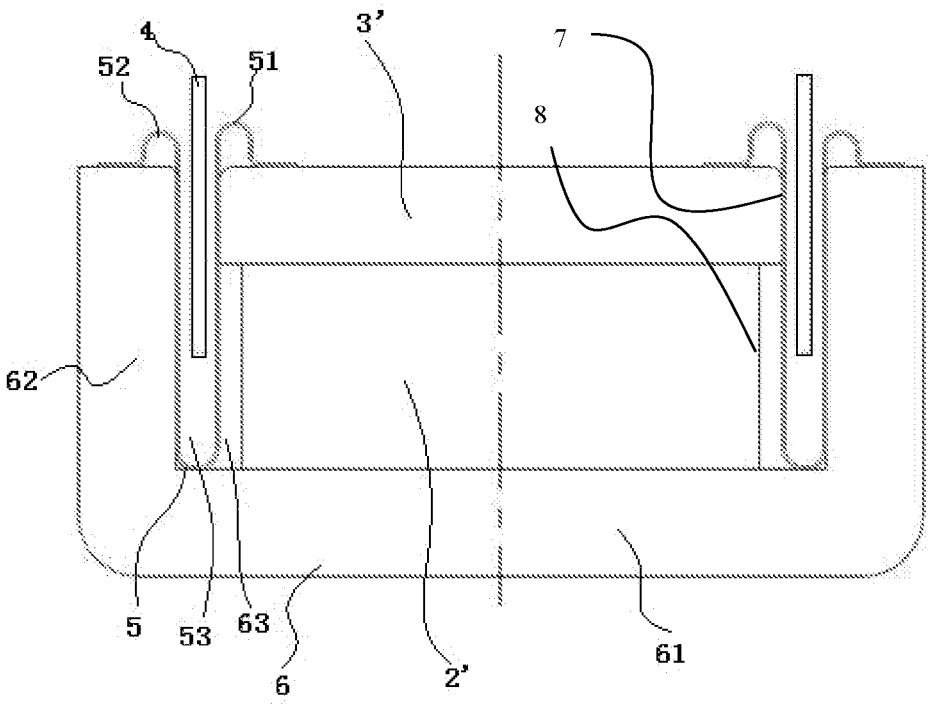
FIG. 5 is a section view of the loudspeaker magnetic circuit system having U-shaped short-circuit ring in Embodiment 4 with a U-shaped iron.

FIG. 5 illustrates a section view of the loudspeaker magnetic circuit system having the U-shaped short-circuit ring in Embodiment 4. As shown in FIG. 5, a loudspeaker magnetic circuit system having a U-shaped short-circuit ring comprises a U-shaped iron 6, a magnetic steel 2', a spring washer 3', a voice coil 4 and a U-shaped short-circuit ring 5. The U-shaped iron 6 includes a bottom portion 61 and a protruding portion 62 extending upward from the bottom portion 61. The magnetic steel 2' and the spring washer 3' are disposed in turn above the bottom portion 61, i.e. the magnetic steel 2' and the spring washer 3' are located in turn above the bottom portion 61. It should be noted that the width of the spring washer 3' is greater than the width of the magnetic steel 2'. A U iron gap slot 63 is formed between the magnetic steel 2', spring washer 3' and the protruding portion 62, and the voice coil 4 and the U-shaped short-circuit ring 5 is positioned in the U iron gap slot 63.

The bottom of the U-shaped short-circuit ring 5 is positioned at the intersection of the bottom portion 61 and the protruding portion 62 of the T-shaped iron 6 and the U-shaped short-circuit 5 is fitted closely with the U-shaped iron 6 to reduce the effects on the magnetic gap space for the stability of the magnetic circuit system.

Further, the U-shaped short-circuit ring 5 comprises a first ring body 51 and a second ring body 52, and the voice coil 4 is positioned and movable up and down in a U-shaped groove 53 formed by the first ring body 51 and the second ring body 52.

In the present embodiment, the first ring body 51 conducts a U-shaped bend downwardly at the end and then is sleeve-connected to the upper end of the spring washer 3'. The second ring body 52 conducts a U-shaped bend downwardly at the end and then is sleeve-connected to the upper end of the spring washer 62.

In the loudspeaker magnetic circuit system of the present embodiment, the short-circuit ring is made into a U-shaped structure comprising a first ring body and a second ring body and the first ring body and second ring body are respectively sleeve-connected with the protruding portion and spring washer such that the overall magnetic circuit system becomes stable and variations in non-linear inductance within the magnetic circuit system decrease to reduce distortion for effectively reducing the harmonic distortion and non-linear distortion of loudspeaker, and the U-shaped short-circuit ring can slow down the increase of electrical resistance for the voice coil with the frequency so as to increase the frequency response output range of loudspeaker, enhance the overall acoustic performance of the speaker and improve the sound quality of loudspeaker.

Embodiment 5

Figure 6:
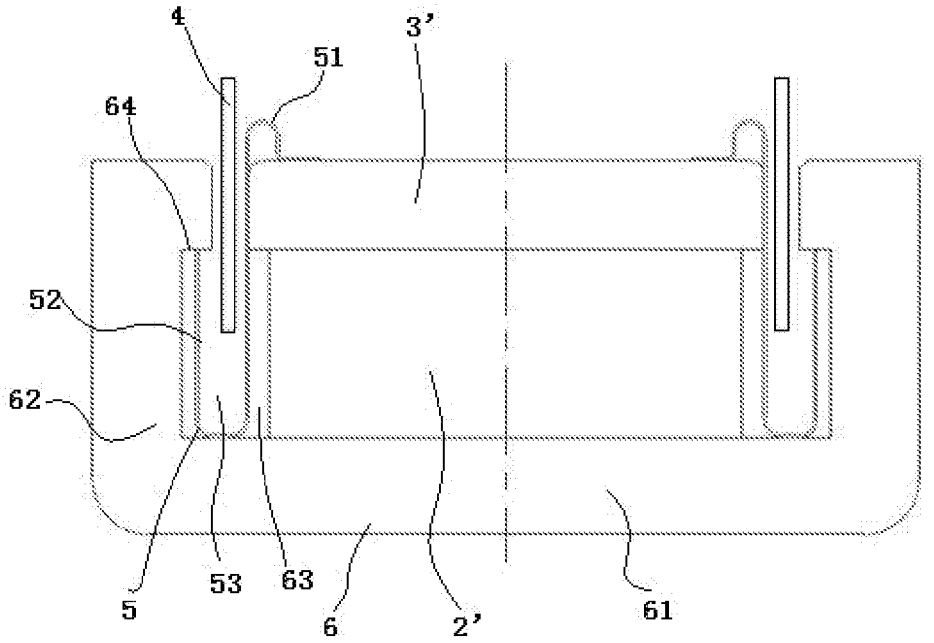
FIG. 6 is a section view of the loudspeaker magnetic circuit system having U-shaped short-circuit ring in Embodiment 5.

FIG. 6 illustrates a section view of the loudspeaker magnetic circuit system having the U-shaped short-circuit ring in Embodiment 5. As shown in FIG. 6, a loudspeaker magnetic circuit system having a U-shaped short-circuit ring comprises a U-shaped iron 6, a magnetic steel 2', a spring washer 3', a voice coil 4 and a U-shaped short-circuit ring 5. The U-shaped iron 6 includes a bottom portion 61 and a protruding portion 62 extending upward from the bottom portion 61. The magnetic steel 2' and the spring washer 3' are disposed in turn above the bottom portion 61, i.e. the magnetic steel 2' and the spring washer 3' are located in turn above the bottom portion 61. The width of the spring washer 3' is greater than the width of the magnetic steel 2'. A U iron gap slot 63 is formed between the magnetic steel 2', spring washer 3' and the protruding portion 62, and the voice coil 4 and the U-shaped short-circuit ring 5 is positioned in the U iron gap slot 63.

The bottom of the U-shaped short-circuit ring 5 is positioned at the intersection of the bottom portion 61 and the protruding portion 62 of the T-shaped iron 6 and the U-shaped short-circuit 5 is fitted closely with the U-shaped iron 6 to reduce the effects on the magnetic gap space for the stability of the magnetic circuit system.

Further, the U-shaped short-circuit ring 5 comprises a first ring body 51 and a second ring body 52, and the voice coil 4 is positioned and movable up and down in a U-shaped groove 53 formed by the first ring body 51 and the second ring body 52.

In the present embodiment, a protruding block 64 is formed inward from above the protruding portion 62 and the second ring body 52 is sleeve-connected to the lower end of the protruding block 64. The first ring body 51 conducts a U-shaped bend downwardly at the end and then is sleeve-connected to the upper end of the spring washer 3'.

In the loudspeaker magnetic circuit system of the present embodiment, the short-circuit ring is made into a U-shaped structure comprising a first ring body and a second ring body and the first ring body and second ring body are respectively sleeve-connected with the protruding portion and spring washer such that the overall magnetic circuit system becomes stable and variations in non-linear inductance within the magnetic circuit system decrease to reduce distortion for effectively reducing the harmonic distortion and non-linear distortion of loudspeaker, and the U-shaped short-circuit ring can slow down the increase of electrical resistance for the voice coil with the frequency so as to increase the frequency response output range of loudspeaker, enhance the overall acoustic performance of the speaker and improve the sound quality of loudspeaker.

Embodiment 6

Figure 7:
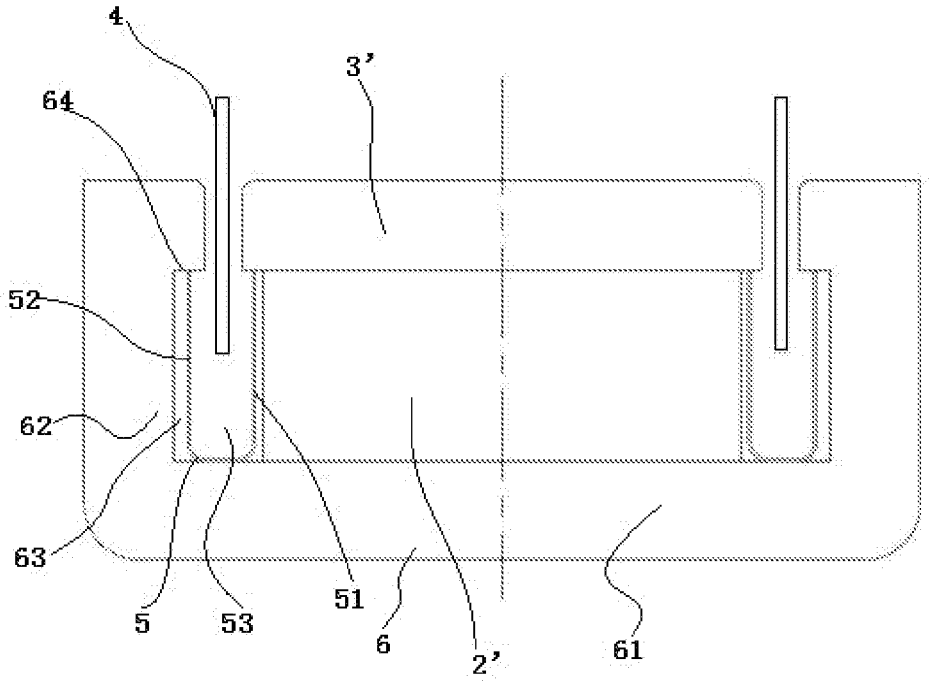
FIG. 7 is a section view of the loudspeaker magnetic circuit system having U-shaped short-circuit ring in Embodiment 6.

FIG. 7 illustrates a section view of the loudspeaker magnetic circuit system having the U-shaped short-circuit ring in Embodiment 6. As shown in FIG. 7, a loudspeaker magnetic circuit system having a U-shaped short-circuit ring comprises a U-shaped iron 6, a magnetic steel 2', a spring washer 3', a voice coil 4 and a U-shaped short-circuit ring 5. The U-shaped iron 6 includes a bottom portion 61 and a protruding portion 62 extending upward from the bottom portion 61. The magnetic steel 2' and the spring washer 3' are disposed in turn above the bottom portion 61, i.e. the magnetic steel 2' and the spring washer 3' are located in turn above the bottom portion 61. The width of the spring washer 3' is greater than the width of the magnetic steel 2'. A U iron gap slot 63 is formed between the magnetic steel 2', spring washer 3' and the protruding portion 62, and the voice coil 4 and the U-shaped short-circuit ring 5 is positioned in the U iron gap slot 63.

The bottom of the U-shaped short-circuit ring 5 is positioned at the intersection of the bottom portion 61 and the protruding portion 62 of the T-shaped iron 6 and the U-shaped short-circuit 5 is fitted closely with the U-shaped iron 6 to reduce the effects on the magnetic gap space for the stability of the magnetic circuit system.

Further, the U-shaped short-circuit ring 5 comprises a first ring body 51 and a second ring body 52, and the voice coil 4 is positioned and movable up and down in a U-shaped groove 53 formed by the first ring body 51 and the second ring body 52.

In the present embodiment, a protruding block 64 is formed inward from above the protruding portion 62 and the second ring body 52 is sleeve-connected to the lower end of the protruding block 64. The first ring body 51 is sleeve-connected to the lower end of the spring washer 3'.

In the loudspeaker magnetic circuit system of the present embodiment, the short-circuit ring is made into a U-shaped structure comprising a first ring body and a second ring body and the first ring body and second ring body are respectively sleeve-connected with the protruding portion and spring washer such that the overall magnetic circuit system becomes stable and variations in non-linear inductance within the magnetic circuit system decrease to reduce distortion for effectively reducing the harmonic distortion and non-linear distortion of loudspeaker, and the U-shaped short-circuit ring can slow down the increase of electrical resistance for the voice coil with the frequency so as to increase the frequency response output range of loudspeaker, enhance the overall acoustic performance of the speaker and improve the sound quality of loudspeaker.

The foregoing is merely illustrative and illustrative of the structure of the invention, and the description thereof is more specific and detailed, but is not to be construed as limiting the scope of the invention. It should be noted that various modifications and improvements can be made by those skilled in the art without departing from the spirit of the invention, and these obvious alternatives are within the scope of the present invention.

LIST

1. T-shaped iron
2. Magnetic steel
3. Spring washer
4. Voice coil
5. U-shaped short-circuit ring
6. U-shaped iron
7. Inner side of spring washer (3)
8. Inner side of magnetic steel (2)
11 Transverse portion (of T-shaped iron 2)
12 Vertical portion (of T-shaped iron 2)
13 T iron gap slot
14 Protrusion (of vertical portion 12)
51. First ring body
52. Second ring body
53. U-shaped groove
61. Bottom portion (of U-shaped iron 6)
62. Protruding portion (of U-shaped iron 6)
63. U iron gap slot
64. Protruding block (of protruding portion 62)

The invention claimed is:

1. A loudspeaker magnetic circuit system, comprising:
an iron, comprising:
a transverse portion; and
a vertical portion extending upward from the transverse portion;
a magnetic steel positioned above the transverse portion;
a spring washer positioned above the transverse portion, an inner side of the spring washer being closer to the vertical portion than an inner side of the magnetic steel;
a voice coil;
a U-shaped short-circuit ring comprising:
a first ring body;
a second ring body; and
a U-shaped groove formed by the first ring body and the second ring body, the voice coil being positioned in and movable up and down in the U-shaped groove; and
an iron gap slot formed between the magnetic steel, the spring washer and the vertical portion, the voice coil and the U-shaped short-circuit ring being positioned in the iron gap slot,
wherein the first ring body is sleeve-connected on the vertical portion and the second ring body is sleeve-connected on the magnetic steel or the spring washer.

2. The loudspeaker magnetic circuit system according to claim 1, wherein the iron is a T-shaped iron; and
wherein the vertical portion extends upward from the center of the transverse portion.

3. The loudspeaker magnetic circuit system according to claim 2, wherein a bottom of the U-shaped short-circuit ring is positioned at an intersection of the transverse portion and the vertical portion of the T-shaped iron.

4. The loudspeaker magnetic circuit system according to claim 1, wherein the first ring body conducts a U-shaped bend downwardly at an end and is sleeve-connected to an upper end of the vertical portion, and wherein the second ring body conducts a U-shaped bend downwardly at an end and is sleeve-connected to an upper end of the spring washer.

5. The loudspeaker magnetic circuit system according to claim 1, wherein the first ring body conducts a U-shaped bend downwardly at an end and is sleeve-connected to an upper end of the vertical portion, and wherein the second ring body is sleeve-connected to a lower end of the spring washer.

6. The loudspeaker magnetic circuit system according to claim 1, further comprising a protrusion formed outward at an upper end of the vertical portion, wherein the first ring body is sleeve-connected to a lower end of the protrusion, and wherein the second ring body is sleeve-connected to a lower end of the spring washer.

7. The loudspeaker magnetic circuit system according to claim 1, wherein the iron is a U-shaped iron, and wherein a width of the spring washer is greater than a width of the magnetic steel.

8. The loudspeaker magnetic circuit system according to claim 1, wherein a bottom of the U-shaped short-circuit ring is positioned at an intersection of a bottom portion and a protruding portion of the U-shaped iron.

9. The loudspeaker magnetic circuit system according to claim 1, wherein the first ring body conducts a U-shaped bend downwardly at an end and is sleeve-connected to an upper end of the spring washer, and wherein the second ring body conducts a U-shaped bend downwardly at an end and is sleeve-connected to an upper end of the protruding portion.

10. The loudspeaker magnetic circuit system according to claim 8, further comprising a protruding block formed inward from above the protruding portion, wherein the second ring body is sleeve-connected to a lower end of the protruding block, and wherein the first ring body conducts a U-shaped bend downwardly at an end and is sleeve-connected to an upper end of the spring washer.

11. The loudspeaker magnetic circuit system according to claim 8, further comprising a protruding block formed inward at an upper end of the protruding portion, wherein the second ring body is sleeve-connected to a lower end of the protruding block, and wherein the first ring body is sleeve-connected to a lower end of the spring washer.

* * * * *